US009358784B2

(12) United States Patent
Oya

(10) Patent No.: US 9,358,784 B2
(45) Date of Patent: Jun. 7, 2016

(54) LIQUID EJECTING HEAD, LIQUID EJECTING APPARATUS, AND METHOD FOR MANUFACTURING LIQUID EJECTING HEAD

(71) Applicant: Seiko Epson Corporation, Tokyo (JP)

(72) Inventor: Kazufumi Oya, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/678,317

(22) Filed: Apr. 3, 2015

(65) Prior Publication Data

US 2015/0283813 A1 Oct. 8, 2015

(30) Foreign Application Priority Data

Apr. 4, 2014 (JP) ..... 2014-077581

(51) Int. Cl.

| | |
|---|---|
| ***B41J 2/045*** | (2006.01) |
| ***B41J 2/14*** | (2006.01) |
| ***B41J 2/16*** | (2006.01) |

(52) U.S. Cl.

CPC ..... *B41J 2/14233* (2013.01); *B41J 2/161* (2013.01); *B41J 2/1623* (2013.01); *B41J 2/1628* (2013.01); *B41J 2/1629* (2013.01); *B41J 2/1631* (2013.01); *B41J 2/1632* (2013.01); *B41J 2/1639* (2013.01); *B41J 2/1642* (2013.01); *B41J 2/1643* (2013.01); *B41J 2/1645* (2013.01); *B41J 2/1646* (2013.01); *B41J 2002/14241* (2013.01); *B41J 2002/14306* (2013.01); *B41J 2002/14419* (2013.01); *B41J 2002/14491* (2013.01); *Y10T 29/49401* (2015.01)

(58) Field of Classification Search

CPC ..... B41J 2/14145; B41J 2/14201; B41J 2002/14241; B41J 2002/14225; B41J 2002/14306

See application file for complete search history.

(56) References Cited

U.S. PATENT DOCUMENTS

| | | | | |
|---|---|---|---|---|
| 7,585,423 | B2 * | 9/2009 | Nakanishi | B41J 2/14233 216/27 |
| 2013/0120500 | A1 | 5/2013 | Fukuda | |
| 2014/0362142 | A1 * | 12/2014 | Takaai | B41J 2/14201 347/71 |

FOREIGN PATENT DOCUMENTS

| | | | |
|---|---|---|---|
| JP | 2005-297475 | A | 10/2005 |
| JP | 2008-273001 | A | 11/2008 |
| JP | 2013-103392 | A | 5/2013 |

* cited by examiner

*Primary Examiner* — Geoffrey Mruk

(74) *Attorney, Agent, or Firm* — Harness, Dickey & Pierce, P.L.C.

(57) ABSTRACT

A liquid ejecting head includes a nozzle opening that is formed on one face of a silicon substrate, and ejects liquid, a first concave portion that is provided on the other face of the silicon substrate, and configures a pressure generating chamber which communicates with the nozzle opening, and a second concave portion that is provided on one face of the silicon substrate, and configures a flow path which communicates with the first concave portion and supplies the liquid, in which the first concave portion and the second concave portion overlap each other in an in-plane direction when seen in a direction which is orthogonal to the face of the silicon substrate.

8 Claims, 10 Drawing Sheets

LIQUID EJECTING HEAD, LIQUID EJECTING APPARATUS, AND METHOD FOR MANUFACTURING LIQUID EJECTING HEAD

BACKGROUND

1. Technical Field

The present invention relates to a liquid ejecting head which discharges liquid from a nozzle opening, and a liquid ejecting apparatus, as well as a method for manufacturing a liquid ejecting head.

2. Related Art

For example, an ink jet type recording head which is an example of a liquid ejecting head, includes a piezoelectric actuator that is a piezoelectric element on one side of a flow path forming substrate where a pressure generating chamber which communicates with a nozzle opening is provided. A vibration plate is deformed by a drive of the piezoelectric actuator, and a pressure change occurs in the pressure generating chamber, and thereby the ink jet type recording head ejects an ink droplet from a nozzle.

As such the ink jet type recording head, in order to satisfy a demand for high densification and miniaturization while securing high processing accuracy and high reliability, an ink jet type recording head has been known in which a nozzle plate and the flow path forming substrate are formed by using silicon substrates (see JP-A-2005-297475). However, there is a problem in workability at the time of joining the substrates, the processing accuracy of a joining process, or the like.

Moreover, an ink jet type recording head has been disclosed in which nozzle opening, a pressure generating chamber and a reservoir are integrally formed on a silicon substrate (see JP-A-2008-273001). Furthermore, an ink jet type recording head has been disclosed in which a flexible film is provided on a nozzle forming face side to form a compliance portion, thereby, achieving reduction in an area (see JP-A-2013-103392).

However, in a technology of JP-A-2008-273001, the substrate where the nozzle opening, the pressure generating chamber and the reservoir are integrally formed from a high-priced silicon wafer, is necessarily formed with a large area, and does not sufficiently satisfy the demand for miniaturization, and furthermore, the number of products which are obtained from the silicon wafer is greatly small, and thus, there is the problem that a high cost is required. Additionally, in the technology of JP-A-2013-103392, the nozzle plate is not the silicon substrate, and the problem in a processing operation of joining a flow path substrate, a communication plate and the nozzle plate, is not solved.

Such the problems are similarly present in not only the ink jet type recording head, but also the liquid ejecting head which ejects liquid other than the ink.

SUMMARY

An advantage of some aspects of the invention is to provide a liquid ejecting head which achieves miniaturization and cost reduction by efficiently using a silicon substrate, and a liquid ejecting apparatus, as well as a method for manufacturing a liquid ejecting head.

According to an aspect of the invention, there is provided a liquid ejecting head including a nozzle opening that is formed on one face of a silicon substrate, and ejects liquid, a first concave portion that is provided on the other face of the silicon substrate, and configures a pressure generating chamber which communicates with the nozzle opening, and a second concave portion that is provided on one face of the silicon substrate, and configures a flow path which communicates with the first concave portion and supplies the liquid, in which the first concave portion and the second concave portion overlap each other in an in-plane direction when seen in a direction which is orthogonal to the face of the silicon substrate. That is, the first concave portion and the second concave portion are superposed in a planar view of the face of the silicon substrate.

In this case, since the flow path and the pressure generating chamber are integrally formed with a configuration not including a reservoir, it is possible to achieve the miniaturization and thinning. That is, a spot which is configured by stacking a cavity substrate where the pressure generating chamber is formed, a nozzle plate where the nozzle opening is formed, a communication plate forming the flow path therebetween, and a spacer in the related art, is configured of one sheet of silicon substrate, and the first concave portion and the second concave portion overlap each other, and thereby, it is possible to achieve the drastic reduction in a stacking process of the substrate, or a material substrate. Moreover, it is possible to prevent a bending or an error which is caused by the stacking, and it is possible to realize the liquid ejecting head with high dimensional accuracy at a low cost.

Here, it is preferable that the liquid ejecting head further includes a vibration plate that seals the first concave portion, and generates pressure within the pressure generating chamber, is further included on the other face of the silicon substrate, and a sealing plate that seals the second concave portion, and configures a portion of a wall face of the flow path, on one face of the silicon substrate. In this case, by sealing the first concave portion and the second concave portion, it is possible to configure the pressure generating chamber and a manifold.

In the liquid ejecting head, it is preferable that a reservoir which reserves the liquid, is placed on an outside of the silicon substrate on a side of an end face connecting one face and the other face of the silicon substrate, or is placed on the outside of the silicon substrate on the other face side. In this case, it is possible to achieve the reduction in an area of a flow path substrate, and it is possible to greatly increase the number of products which are obtained from one sheet of silicon substrate, and it is possible to achieve the cost reduction.

In the liquid ejecting head, it is preferable that the reservoir is placed on the outside of the silicon substrate on the end face side, and a flexible film which is placed to face the reservoir, is included in at least a portion of the sealing plate. In this case, it is possible to provide a compliance portion by arranging the reservoir on the outside of the silicon substrate on the end face, and it is possible to achieve the reduction in the area of the flow path substrate, and it is possible to greatly increase the number of products which are obtained from one sheet of silicon substrate, and it is possible to achieve the cost reduction.

In the liquid ejecting head, it is preferable that the sealing plate configures a fixing plate that is placed on an outermost side of the silicon substrate on the other face side where the nozzle opening is formed. In this case, by sealing the reservoir and the flow path using the fixing plate, it is possible to achieve the reduction in the number of components, and the cost reduction.

In the liquid ejecting head, it is preferable that a stepped concave portion which accommodates the sealing plate, and of which a depth is larger than a thickness of the sealing plate, is provided on one face of the silicon substrate, and the second concave portion is placed on an inside of the stepped concave portion. In this case, by joining the sealing plate and the stepped concave portion, a structure that the sealing plate does not protrude from a liquid ejecting face, is made, and it is possible to prevent the sealing plate and a wiper from interfering with each other in a wiping operation of the liquid ejecting face.

According to another aspect of the invention, there is provided a liquid ejecting apparatus on which the liquid ejecting head is mounted.

In this case, it is possible to realize the liquid ejecting apparatus including the liquid ejecting head achieving the high dimensional accuracy at the low cost in which the drastic reduction in the stacking process of the substrate, or the material substrate is achieved, and moreover, the bending or the error which is caused by the stacking is prevented.

According to still another aspect to the invention, there is provided a method for manufacturing a liquid ejecting head that includes a nozzle opening, a pressure generating chamber which communicates with the nozzle opening, and a flow path which communicates with the pressure generating chamber and an external reservoir, including forming the nozzle opening, and a flow path concave portion which configures the flow path, on one face of a silicon substrate, forming a pressure generating chamber concave portion which configures the pressure generating chamber, and communicating with the nozzle opening and the pressure generating chamber concave portion, on the other face of the silicon substrate, and communicating with the pressure generating chamber concave portion and the flow path concave portion.

In this case, it is possible to reduce a material cost since the configuration which does not include the reservoir asking for a great area is adopted, and the flow path and the pressure generating chamber are integrally formed, and thus, it is possible to manufacture the liquid ejecting head at the low cost without a processing cost of a bonding process due to separate members. That is, the spot which is configured by stacking the cavity substrate where the pressure generating chamber is formed, the nozzle plate where the nozzle opening is formed, the communication plate forming the flow path therebetween, and the spacer in the related art, is configured of one sheet of silicon substrate, and the first concave portion and the second concave portion overlap each other, and thereby, it is possible to achieve the drastic reduction in the stacking process of the substrate, or the material substrate. Moreover, it is possible to prevent the bending or the error which is caused by the stacking, and it is possible to realize the liquid ejecting head with the high dimensional accuracy at the low cost.

Here, it is preferable that the method for manufacturing a liquid ejecting head further includes thinning the silicon substrate into a desired thickness, before the forming the pressure generating chamber concave portion, and communicating with the nozzle opening and the pressure generating chamber concave portion, in which the other face of the silicon substrate to which the forming the pressure generating chamber concave portion, and communicating with the nozzle opening and the pressure generating chamber concave portion is performed, is a thinned face in the thinning. In this case, since it is possible to manufacture a liquid ejecting head by thinning a commercially available silicon substrate, it is possible to achieve the material cost reduction. Moreover, it is possible to easily cope with design changes by making a silicon nozzle substrate have the desired thickness.

It is preferable that the method for manufacturing a liquid ejecting head further includes providing a stepped concave portion that communicates with the flow path concave portion, and of which a depth from one face is shallower than the flow path concave portion, on one face of the silicon substrate. In this case, by joining the sealing plate and the stepped concave portion, the structure that the sealing plate does not protrude from the liquid ejecting face, is made, and it is possible to prevent the sealing plate and the wiper from interfering with each other in the wiping operation of the liquid ejecting face.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail, based on embodiments.

First Embodiment

Figure 1:
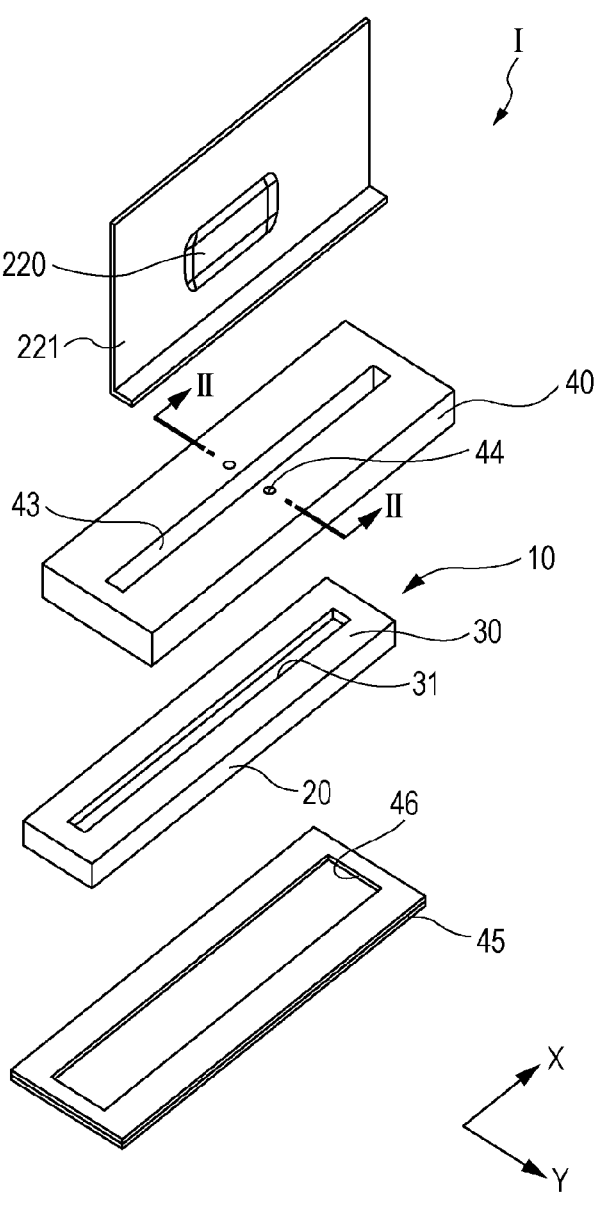
FIG. 1 is an exploded perspective view of a recording head according to a first embodiment of the invention.
Figure 2:
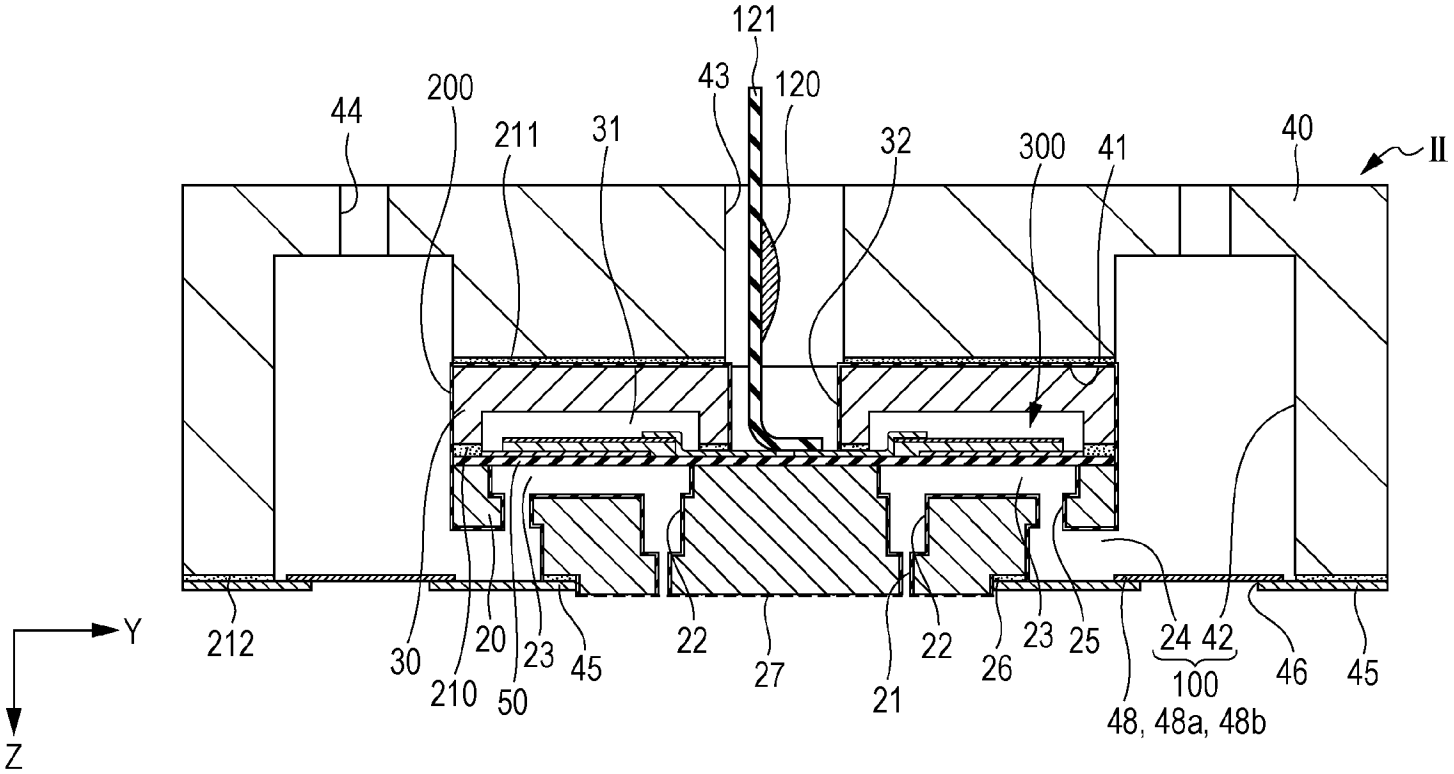
FIG. 2 is a cross-sectional view of the recording head according to the first embodiment of the invention.
Figure 3A:
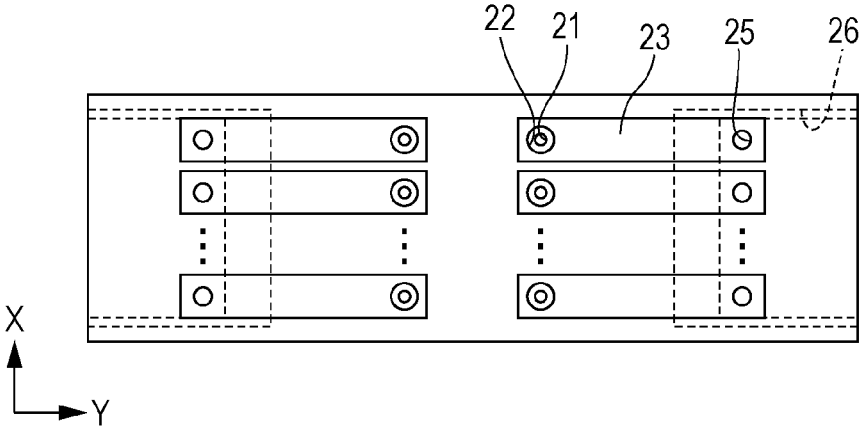
FIG. 3A is a plan view of a flow path forming substrate according to the first embodiment of the invention.
Figure 3B:
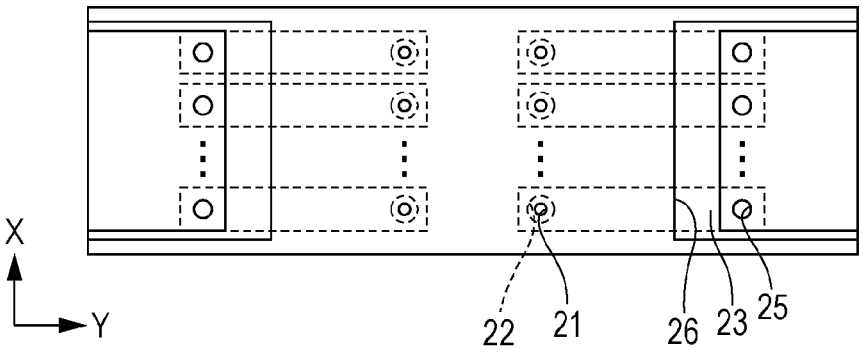
FIG. 3B is a rear view thereof.

FIG. 1 is an exploded perspective view of an ink jet type recording head which is an example of a liquid ejecting head according to a first embodiment of the invention. FIG. 2 is a cross-sectional view along an II-II line of the ink jet type recording head. FIG. 3A is a plan view of a flow path forming substrate, and FIG. 3B is a rear view thereof.

As illustrated in the drawings, an ink jet type recording head I which is an example of the liquid ejecting head of the first embodiment, includes a plurality of members such as a head main body 10, a case member 40 and a fixing plate 45, and the plurality of members are joined by an adhesive agent. In the first embodiment, the head main body 10 includes a flow path forming substrate 20, and a protective substrate 30. In the first embodiment, as described later in detail, the flow path forming substrate 20 and the protective substrate 30 are formed of silicon substrates (silicon single crystal substrates).

In the first embodiment, the flow path forming substrate 20 configuring the head main body 10, is made up of the silicon single crystal substrate. On one face (referred to as liquid ejecting face 20*a*, hereinafter) of the flow path forming substrate 20, a plurality of nozzle openings 21 which discharge the same color ink, are arranged in a line shape, and are arranged in parallel into a plurality of lines. In the first embodiment, the nozzle lines of two lines are arranged.

Each nozzle opening 21 is made up of a cylindrical portion (straight portion) of which an inner diameter is fixed, but is not limited thereto. For example, the nozzle opening 21 may be configured from two successive cylinder-shaped hollow portions of which the inner diameters are different. In other words, the nozzle opening 21 may be configured from a first cylindrical portion of a small inner diameter which is formed on a side where the ink is discharged in a plate thickness direction of the flow path forming substrate 20, that is, the liquid ejecting face 20*a* side, and a second cylindrical portion of a large inner diameter which is formed on an opposite side to the liquid ejecting face 20*a*, that is, the ink flow path side. Moreover, a shape of the nozzle opening 21 is not limited to the example. For example, the nozzle opening 21 may be configured from the cylindrical portion (straight portion) of which the inner diameter is fixed, and a taper portion of which the inner diameter is gradually expanded from the liquid ejecting face 20*a* side toward a pressure generating chamber 12 side.

In each nozzle opening 21, respectively, a pressure generating chamber 23 is arranged. The pressure generating chamber 23 communicates with the nozzle opening 21, through a nozzle communication hole 22 that is the cylindrical portion of which the inner diameter is greater than the nozzle opening 21, and is made up of a first concave portion which is opened on the other face of the flow path forming substrate 20. A plurality of pressure generating chambers 23 are arranged in parallel in the same direction as the nozzle opening 21, and the pressure generating chambers 23 of two lines are arranged in a direction orthogonal to the parallel arrangement direction. Hereinafter, the parallel arrangement direction of the nozzle opening 21 and the pressure generating chamber 23, is referred to as a first direction X. Moreover, in the flow path forming substrate 20, the plurality of lines where the pressure generating chambers 23 are arranged in parallel in the first direction X as described above, are formed. In the first embodiment, hereinafter, a line arrangement direction where two lines are arranged, is referred to as a second direction Y.

On the other face of the flow path forming substrate 20, a first manifold portion 24 which is a second concave portion, configures a portion of a manifold 100, and becomes a liquid introduction path, is arranged.

A portion of the first manifold portion 24 is arranged in a region where one end portion with which the nozzle communication hole 22 of the pressure generating chamber 23 communicates, and the other end portion of the opposite side are overlapped in a thickness direction, and the plurality of pressure generating chambers 23 are extended across the parallel arrangement direction. In other words, the pressure generating chamber 23 which is the first concave portion, and the first manifold portion 24 which is the second concave portion, are superposed when seen the face of the silicon substrate in a planar view, that is, are overlapped.

Moreover, the plurality of communication holes 25 are arranged so as to communicate with the first manifold portion 24 and the other end portion side of each pressure generating chamber 23, respectively. Furthermore, the end portion of the side which does not overlap with the pressure generating chamber 23 of the first manifold portion 24, is arranged so as to be opened on an end face of the flow path forming substrate 20. In the first embodiment, a whole of the first manifold portion 24 is formed into the same depth, but for example, an orifice flow path communicating with a main body of the manifold 100 and the first manifold portion 24, may be formed by making the depth of the end portion side be shallow and giving flow path resistance.

In the first embodiment, a cross-sectional shape of each hole such as the nozzle communication hole 22 or a communication hole 25 is a true circle. According thereto, the flow path resistance per unit area becomes the minimum, and thus, there is an advantage that each hole can be arranged at high density by reducing a cross-sectional area of each hole.

Furthermore, in the region surrounding the first manifold portion 24 of the liquid ejecting face 20*a* side of the flow path forming substrate 20, a stepped concave portion 26 which is a relatively shallow concave portion, is arranged. The stepped concave portion 26 is a region for bonding the fixing plate 45 as described later, and is formed so that the fixing plate 45 does not protrude to the liquid ejecting face 20*a* side at the time of bonding the fixing plate 45. Hereby, it is possible to favorably perform a wiping or the like by removing a step difference of the liquid ejecting face 20*a*, but if the thickness of the fixing plate 45 is not the problem, the stepped concave portion 26 is not necessarily arranged.

In this manner, a spot which is configured by stacking a cavity substrate where the pressure generating chamber is formed, a nozzle plate where the nozzle opening is formed, a communication plate forming the flow path therebetween, and a spacer in the related art, is configured of one sheet of the flow path forming substrate 20, in the first embodiment. Hereby, it is possible to achieve the drastic reduction in a stacking process of the substrate, or a material substrate. Moreover, it is possible to remove a bending or an error which is caused by the stacking, and it is possible to realize the flow path forming substrate 20 of high dimensional accuracy at a low cost.

On the liquid ejecting face 20*a* of the flow path forming substrate 20, a liquid repellent film 27 having liquid repellency, is arranged.

The liquid repellent film 27 is not particularly limited if having the liquid repellency with respect to the ink. For example, a metal film including a fluorine-based polymer, or a metal alkoxide molecular film having the liquid repellency, may be used.

For example, the liquid repellent film which is made up of the metal film including the fluorine-based polymer, may be formed by performing eutectoid plating directly to the liquid ejecting face 20*a* of the flow path forming substrate 20.

When the metal alkoxide molecular film is used as a liquid repellent film, for example, by arranging a base film which is made up of a plasma polymerized film (PPSi (Plasma Polymerization Silicone) film) on the liquid ejecting face 20*a* side, it is possible to enhance adhesion properties of the liquid repellent film which is made up of the molecular film, and the flow path forming substrate 20. For example, the base film which is made up of the plasma polymerized film, may be formed by polymerizing the silicone by argon plasma gas. Moreover, the liquid repellent film which is made up of the molecular film, may be made as follows. For example, the metal alkoxide molecular film having the liquid repellency, is formed, and thereafter, by drying processing, annealing processing or the like, the liquid repellent film (SCA (silane coupling agent) film) may be made. Incidentally, when the metal alkoxide molecular film is used as a liquid repellent film, there is the advantage where even in a case of arranging the base film, it is possible to form the liquid repellent film to be thinner than the liquid repellent film that is made up of the metal film including the fluorine-based polymer which is formed by the eutectoid plating, and it is possible to enhance "abrasion resistance" that the liquid repellency is not degraded even when the liquid ejecting face 20*a* is wiped by the wiping or the like at the time of cleaning the liquid ejecting face 20*a*, and the liquid repellency. Needless to say, even though "abrasion resistance", and "liquid repellency" are degraded, the liquid repellent film which is made up of the metal film including the fluorine-based polymer, may be used.

On the other hand, on the other face side of the flow path forming substrate 20, that is, the opposite face side to the liquid ejecting face 20*a*, a vibration plate 50 is formed.

On the vibration plate 50, as a pressure generating unit of the first embodiment, a piezoelectric actuator 300 which is made up of a first electrode 60, a piezoelectric layer 70 and a second electrode 80, is arranged. Here, the piezoelectric actuator 300 is referred to as a portion including the first electrode 60, the piezoelectric layer 70 and the second electrode 80. In general, any one of the electrodes of the piezoelectric actuator 300 is used as a common electrode, and the other electrode and the piezoelectric layer 70 are configured by patterning per each pressure generating chamber 12. Here, the portion that is configured from any one of the electrodes and the piezoelectric layer 70 which are patterned, and where piezoelectric distortion is caused by application of a voltage to both electrodes, is referred to as a piezoelectric active portion. In the first embodiment, the first electrode 60 is used as a common electrode of the piezoelectric actuator 300, and the second electrode 80 is used as an individual electrode of the piezoelectric actuator 300, but there is no problem even when used by reversing thereto for convenience of a drive circuit or wiring. In the examples described above, it is exemplified that the vibration plate 50 is configured of an insulator film of one layer, but is not limited thereto, needless to say, and may be configured as a stacked structure of two or more layers. Moreover, without arranging the vibration plate 50, only the first electrode 60 may be configured to be acted as a vibration plate. Still more, the piezoelectric actuator 300 may substantially serve as a vibration plate. However, when the first electrode 60 is arranged directly on the flow path forming substrate 20, there is a need to protect the first electrode 60 by an insulating film (such as a protective film 200) so that the first electrode 60 and the ink are not conducted.

The piezoelectric layer 70 is made up of a piezoelectric material of an oxide having a polarization structure which is formed on the first electrode 60. For example, the piezoelectric layer 70 may be made up of a perovskite type oxide which is represented by a general formula $ABO_3$, and A may include lead, and B may include at least one of zirconium and titanium. For example, furthermore, B may include niobium. Specifically, as a piezoelectric layer 70, for example, lead zirconate titanate (Pb (Zr, Ti) $O_3$: PZT), or lead zirconate titanate niobate including silicon (Pb (Zr, Ti, Nb) $O_3$: PZTNS), may be used.

Moreover, for example, the piezoelectric layer 70, may be made up of a composite oxide having a perovskite structure including a lead-free piezoelectric material which does not include lead, such as bismuth ferrate, bismuth ferrate manganite, barium titanate or bismuth potassium titanate.

Additionally, each one end of a lead electrode 90 is connected to the second electrode 80. A wiring substrate 221 where a drive circuit 220 is arranged, for example, COF is connected to the other end of the lead electrode 90.

On the face of the piezoelectric actuator 300 side of the flow path forming substrate 20, a protective substrate 30 having approximately the same size as the flow path forming substrate 20, is bonded through an adhesive agent 210. The protective substrate 30 has a retaining portion 31 which is a space for protecting the piezoelectric actuator 300. Moreover, a through hole 32 is arranged in the protective substrate 30. The other end side of the lead electrode 90 is extended and arranged so as to be exposed within the through hole 32, and the lead electrode 90 and the wiring substrate 221 are electrically connected within the through hole 32.

In the head main body 10 of such the configuration, a case member 40 along with the head main body 10 forming the manifold 100 which communicates with the plurality of pressure generating chambers 12, is bonded through the adhesive agent 210. The case member 40 has a larger dimension in the second direction Y than the flow path forming substrate 20 in the planar view, and has the shape forming the manifold 100 which becomes a reservoir, on the outside of the second direction Y of the flow path forming substrate 20, and is fixed by the adhesive agent onto the protective substrate 30, and a lower face thereof is fixed through the adhesive agent onto the fixing plate 45. The case member 40 is connected to the flow path forming substrate 20 by the fixing plate 45. Specifically, the case member 40 has a concave portion 41 of the depth where the flow path forming substrate 20 and the protective substrate 30 are accommodated on the protective substrate 30 side. The concave portion 41 has a wider opening area than the flow path forming substrate 20 and the protective substrate 30. Therefore, an opening face of the liquid ejecting face 20*a* side of the flow path forming substrate 20 of the concave portion 41, is sealed by the fixing plate 45 in a state where the flow path forming substrate 20 or the like is accommodated in the concave portion 41. Hereby, a second manifold 42 is formed by the case member 40 and the head main body 10, in an outer peripheral portion of the flow path forming substrate 20. Therefore, the manifold 100 of the first embodiment, is configured by the first manifold portion 24 which is arranged on the flow path forming substrate 20, and the second manifold portion 42 which is formed by the case member 40 and the flow path forming substrate 20.

As a material of the case member 40, for example, a resin, a metal or the like may be used. Moreover, it is preferable that a linear expansion coefficient of the material of the protective substrate 30 is the same as that of the flow path forming substrate 20 to which the protective substrate 30 is bonded, and in the first embodiment, the silicon single crystal substrate is used.

In the case member 40, an introduction path 44 for supplying the ink to each manifold 100 which communicates with the manifold 100, is arranged. Moreover, in the case member 40, a connection port 43 which communicates with the through hole 32 of the protective substrate 30, and into which the wiring substrate 221 is inserted, is arranged.

On the other hand, as described above, the fixing plate 45 is fixed to the stepped concave portion 26 of a peripheral portion of the flow path forming substrate 20, and the lower face of the peripheral portion of the case member 40 by the adhesive agent 210, and forms the liquid ejecting face 20*a* side of the manifold 100. Still more, the fixing plate 45 has an exposed opening portion 46 where the region in which the nozzle opening 21 is formed, is exposed, and an opening for compliance 47. Therefore, the opening for compliance 47 is sealed by a compliance substrate 48.

In the first embodiment, the compliance substrate 48 includes a sealing film 48*a*, and a fixing substrate 48*b*. The Sealing film 48*a* is made up of a thin film having flexibility, for example, a thin film which is formed of a polyphenylene sulfide (PPS) or stainless steel (SUS) and has the thickness of 20 μm or less, and the fixing substrate 48*b* is formed of a hard material of the metal such as the stainless steel (SUS). Since the region that is counter to the manifold 100 of the fixing substrate 48*b*, becomes the opening portion which is entirely removed in the thickness direction, one face of the manifold 100 becomes a compliance portion that is a flexible portion which is sealed only by the sealing film 48*a* having the flexibility.

In the ink jet type recording head I of such the configuration, at the time of ejecting the ink, the ink is taken in through the introduction path 44 from an ink reserving unit such as a cartridge, and the inside of the flow path is filled with the ink till the ink reaches the nozzle opening 21 from the manifold 100. Thereafter, according to a signal from the drive circuit 220, by applying the voltage to the piezoelectric actuator 300 corresponding to the pressure generating chamber 12, the vibration plate 50 along with the piezoelectric actuator 300, are bending deformed. Hereby, the pressure within the pressure generating chamber 23 rises, and an ink droplet is ejected from the predetermined nozzle opening 21.

Here, a protective film 200 is arranged in the flow path forming substrate 20 and the protective substrate 30 which configure the ink jet type recording head I of the first embodiment, and are formed of the silicon substrates (silicon single crystal substrates). The protective film 200 is mainly configured of at least one type of the material that is selected from a group which is made up of a tantalum oxide ($TaO_x$), a hafnium oxide ($HfO_x$) and a zirconium oxide ($ZrO_x$) formed by atomic layer deposition. The protective film 200 may be configured by forming single material or composite material into single layer, or may be configured of a stacked film which is formed by stacking a plurality of materials. Furthermore, the term of being formed by the atomic layer deposition, is referred to as being formed by an atomic layer deposition method (ALD).

Specifically, after the flow path forming substrate 20 and the protective substrate 30 are integrated by being bonded due to the adhesive agent 210, by forming the protective film 200 by the atomic layer deposition method, the protective film 200 is successively formed across a surface of the adhesive agent 210 for bonding the surface (inner face) of an inner wall of the flow path and the substrates.

That is, the protective film 200 is arranged on the inner face of the flow path, till the ink reaches the nozzle opening 21 from the inner face of the manifold 100, that is, the region which is formed by the flow path forming substrate 20, the protective substrate 30 and the case member 40, and is successively arranged over the end face of the adhesive agent 210 which is exposed onto the flow path.

The protective film 200 uses at least one type of the material that is selected from the group which is made up of the tantalum oxide, the hafnium oxide and the zirconium oxide, and thereby, it is possible to suppress the substrates such as the flow path forming substrate 20 and the protective substrate 30 which are made up of the silicon single crystal substrates, the vibration plate 50 and the adhesive agent 210 from being eroded by the ink. Here, the term which is referred to as ink resistance (liquid resistance), means etching resistance with respect to the alkaline or the acid ink (liquid).

Additionally, the protective film 200 is formed by the atomic layer deposition method (ALD), and thereby, it is possible to form the protective film 200 in the dense state at high film density. In this manner, the protective film 200 is formed at the high film density, and thereby, it is possible to enhance the ink resistance (liquid resistance) of the protective film 200. That is, the protective film 200 is formed of at least one of the tantalum oxide ($TaO_x$), the hafnium oxide ($HfO_x$) and the zirconium oxide ($ZrO_x$), and is formed by the atomic layer deposition method (ALD) although having the ink resistance, and thereby, it is possible to further enhance the ink resistance of the protective film 200. Accordingly, the ink resistance of the protective film 200 is enhanced, and it is possible to suppress the vibration plate 50, the flow path forming substrate 20, and the protective substrate 30, as well as the adhesive agent 210 from being eroded (etched) by the ink (liquid). Moreover, since the dense protective film 200 having the high ink resistance can be formed at the high film density by the atomic layer deposition method, it is possible to secure the sufficient ink resistance, even when the protective film 200 is formed into the thin film thickness in comparison with the case of forming the protective film 200 by a CVD method or the like. Accordingly, the protective film 200 is formed into the relatively thin film thickness, and the protective film 200 is suppressed from hindering displacement of the vibration plate 50, and it is possible to suppress a displacement amount of the vibration plate 50 from being lowered. Still more, since the vibration plate 50 is suppressed from being eroded by the ink, the dispersion in displacement characteristics of the vibration plate 50, is suppressed from being generated, and the vibration plate 50 can be deformed in the stable displacement characteristics.

For example, the protective film 200 may be formed by a method in addition to the atomic layer deposition method, such as a sputtering method or the CVD method, but it is difficult to form the protective film into a complex shape, that is, in the uniform thickness on the faces of which the directions are different.

The thickness of the protective film 200 that is formed by such the atomic layer deposition method, may be formed into the thickness which is 0.3 Å or more and 50 nm or less, and is preferably in the range of 10 nm or more and nm or less. That is, according to the atomic layer deposition method, it is possible to easily form the protective film 200 at high accuracy into the relatively thin thickness such as 50 nm or less. Moreover, since the protective film 200 that is formed by the atomic layer deposition method, is formed at the high film density, it is possible to secure the sufficient ink resistance into the thickness of 0.3 Å or more. Still more, $Ta_2O_5$ ($TaO_x$) is soluble into an alkali, but is unlikely to be dissolved into the alkali if the film density is high (approximately 7 g/cm$^2$). The acid resistance has the characteristics that is unlikely to be dissolved into a solution other than the hydrogen fluoride solution, and thus, $Ta_2O_5$ ($TaO_x$) is effective as a protective film with respect to the strong alkaline solution or the strong acid solution. Furthermore, $ZrO_2$ is insoluble into the alkali, and the acid resistance has the characteristics that is unlikely to be dissolved into the solution other than the sulfuric acid solution and the hydrofluoric acid solution, and thus, $ZrO_2$ is effective as a protective film with respect to the strong alkaline solution or the strong acid solution. Additionally, since $HfO_2$ has the characteristics that is insoluble into not only the alkali but also the acid, $HfO_2$ is all-purpose protective film as a protective film with respect to the strong alkaline solution or the strong acid solution. Incidentally, if the protective film 200 is formed to be thicker than 50 nm, the film formation takes the time, and the cost becomes high, and thus, it is not preferable. Moreover, if the protective film 200 is formed to be thinner than 50 nm, there is a concern that the uniform film is not formed on the whole, and thus, it is not preferable.

In this manner, by making the thickness of the protective film 200 be thin, it is possible to reduce that the protective film 200 inhibits the displacement of the vibration plate 50, and it is possible to enhance the displacement of the piezoelectric actuator 300. Moreover, since the thickness of the protective film 200 can be thin, even if the thickness of the flow path forming substrate 20 is thin, it is possible to secure a volume of the pressure generating chamber 12. Still more, since the displacement of the piezoelectric actuator 300 can be enhanced, it is possible to make the thickness of the piezoelectric actuator 300 be thin. Accordingly, it is possible to realize the thinning of the ink jet type recording head I, and high densification of the nozzle opening 21.

Here, a structure of the flow path forming substrate and a method for manufacturing the same of the first embodiment, will be described with reference to FIG. 4A to FIG. 7E. FIG. 4A to FIG. 6D are enlarged cross-sectional views of a main portion illustrating the method for manufacturing a flow path forming substrate according to the first embodiment of the invention.

Figure 4A:
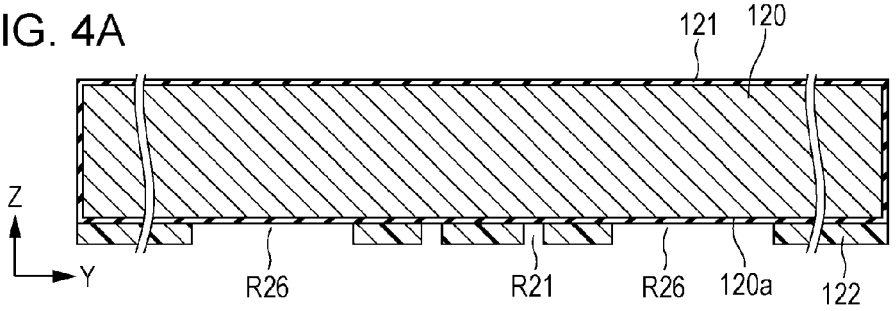
FIGS. 4A to 4D are cross-sectional views illustrating a method for manufacturing a flow path forming substrate according to the first embodiment of the invention.

As illustrated in FIG. 4A, for example, by performing wet type thermal oxidation to a wafer for flow path forming substrate 120 having the thickness of 725 μm which is a silicon wafer and becomes the plurality of the flow path forming substrates 20, an oxide film 121 having the thickness of 0.5 μm which is made up of silicon dioxide is formed, and thereafter, a photosensitive resist layer having the thickness of 4 μm is formed by spin coating, on a nozzle face 120*a* which becomes the liquid ejecting face 20*a* and is a mirror face side. A region R21 which becomes the nozzle opening 21, and a region R26 which becomes the stepped concave portion 26 by photolithography, are removed, and a resist pattern 122 is formed.

Figure 4B:
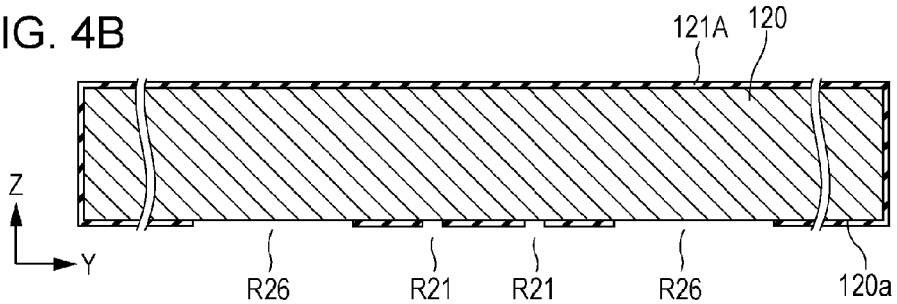

Next, as illustrate in FIG. 4B, by performing the reactive ion etching on the nozzle face 120*a* side, the oxide film 121 of the region R21 which becomes the nozzle opening 21 and the region R26 which becomes the stepped concave portion 26, is removed, and an oxide film pattern 121A is formed. Thereafter, the resist pattern 122 is removed, for example, by washing with sulfuric acid hydrogen peroxide. Here, the reactive ion etching is referred to as the etching which is controlled so that the radical in the plasma by self bias potential is incident in a sample direction, and the etching vertically advances, for example, using inductively coupled plasma.

Figure 4C:
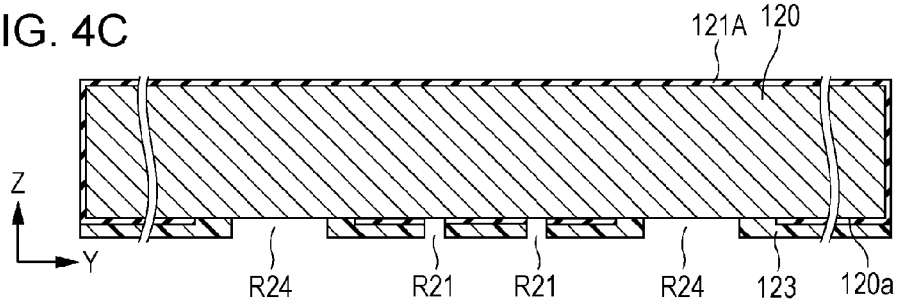

As illustrate in FIG. 4C, on the nozzle face 120*a*, for example, the photosensitive resist layer having the thickness of 4 μm is formed by the spin coating, and the region R21 which becomes the nozzle opening 21, and a region R24 which becomes the first manifold portion 24 by the photolithography, are removed, and a resist pattern 123 is formed.

Figure 4D:
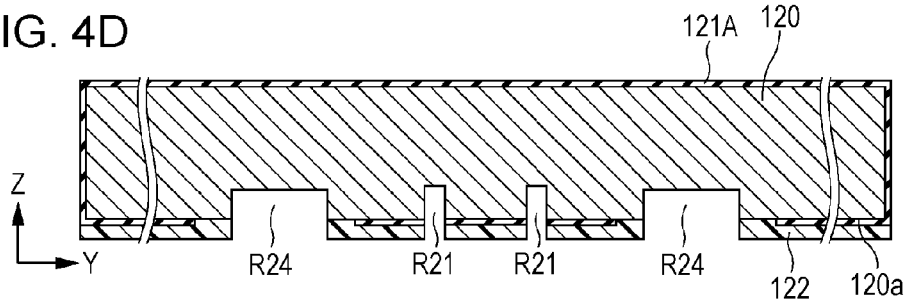

Next, as illustrated in FIG. 4D, by using the resist pattern 123 as a mask and performing anisotropic dry etching, the region R21 which becomes the nozzle opening 21, and the region R24 which becomes the first manifold portion 24 are etched, for example, to the depth of 30 μm. Here, the anisotropic dry etching is referred to as the etching which is controlled so that the etching vertically advances by alternately repeating an etching step and a deposition step, for example, using the inductively coupled plasma.

Figure 5A:
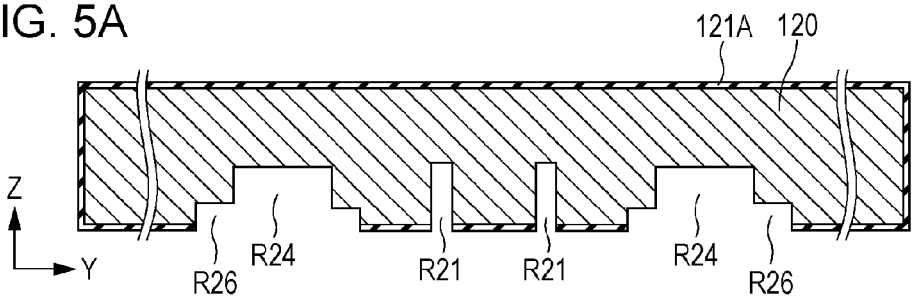
FIGS. 5A to 5D are cross-sectional views illustrating the method for manufacturing a flow path forming substrate according to the first embodiment of the invention.

Next, as illustrate in FIG. 5A, for example, the resist pattern 123 is removed by washing with the sulfuric acid hydrogen peroxide, and thereafter, by using the oxide film pattern 121A as a mask, the region R21 which becomes the nozzle opening 21, and the region R26 which becomes the stepped concave portion 26 are etched by the anisotropic dry etching, for example, only to the depth of 20 μm. At this time, the region R24 which becomes the first manifold portion 24 is etched into the intact shape, and the depth becomes 50 μm.

Figure 5B:
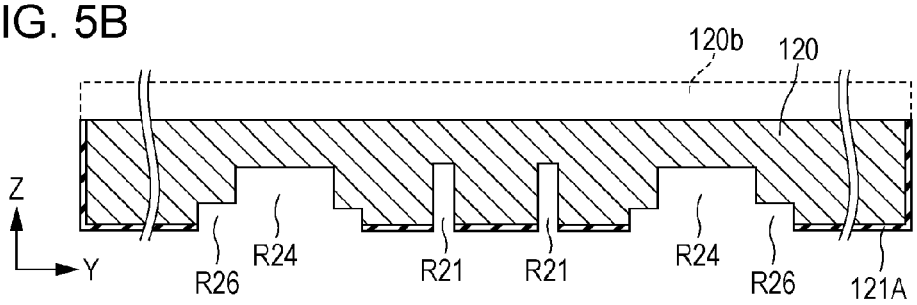

As illustrated in FIG. 5B, a flow path face 120*b* which is the opposite side to the nozzle face 120*a* and is a bright etching face, is ground, for example, till the thickness becomes 120 μm.

Figure 5C:
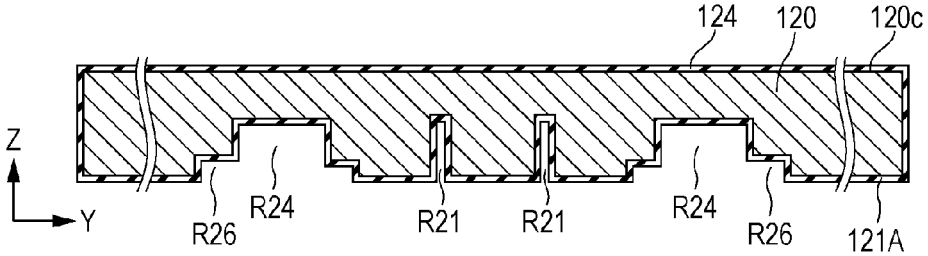

Next, as illustrated in FIG. 5C, for example, the oxide film pattern 121A is removed by hydrofluoric acid, and thereafter, by the wet type thermal oxidation, for example, an oxide film 124 having the thickness of 0.5 μm, is formed.

Figure 5D:
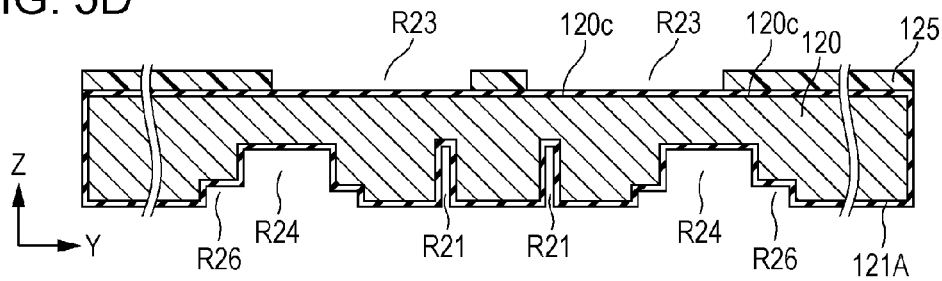

As illustrated in FIG. 5D, on a grinding face 120*c* side, for example, the photosensitive resist layer having the thickness of 4 μm is formed by the spin coating, and a region R23 which becomes the pressure generating chamber 23 by the photolithography, is removed, and a resist pattern 125 is formed.

Figure 6A:
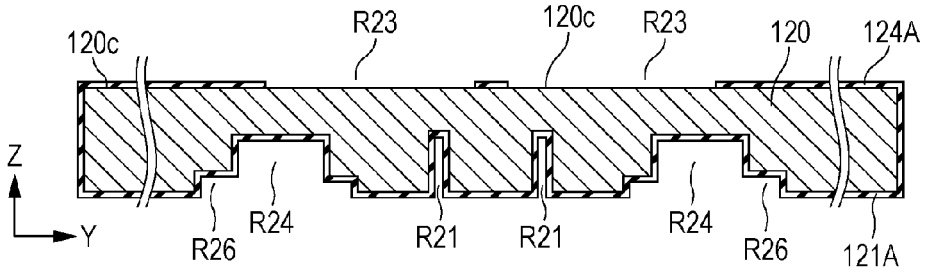
FIGS. 6A to 6D are cross-sectional views illustrating the method for manufacturing a flow path forming substrate according to the first embodiment of the invention.

Next, as illustrate in FIG. 6A, by using the resist pattern 125 as a mask and performing the reactive ion etching, the oxide film 124 of the region R23 which becomes the pressure generating chamber 23, is removed, and an oxide film pattern 124A is formed.

Figure 6B:
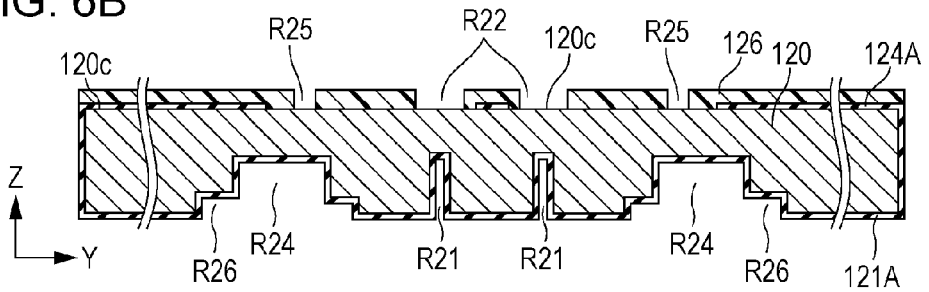

As illustrated in FIG. 6B, on the grinding face 120*c* side, for example, the photosensitive resist layer having the thickness of 4 μm is formed by the spin coating, and a region R22 which becomes the nozzle communication hole 22, and a region R25 which becomes the communication hole 25 by the photolithography, are removed, and a resist pattern 126 is formed.

Figure 6C:
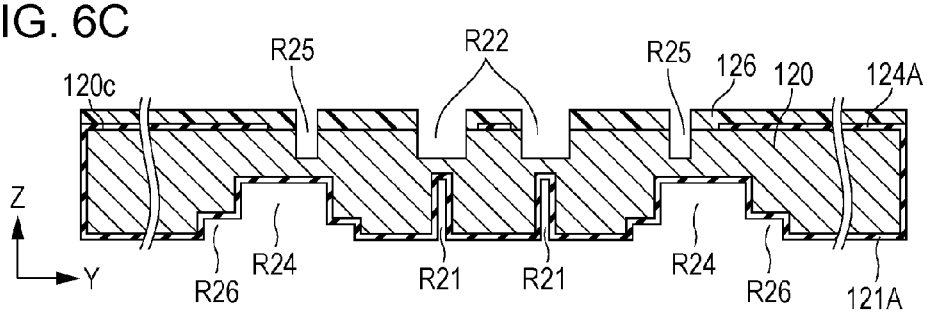

Next, as illustrated in FIG. 6C, by using the resist pattern 126 as a mask and performing the anisotropic dry etching, the region R22 which becomes the nozzle communication hole 22, and the region R25 which becomes the communication hole 25 are etched, for example, to the depth of 50 μm.

Figure 6D:
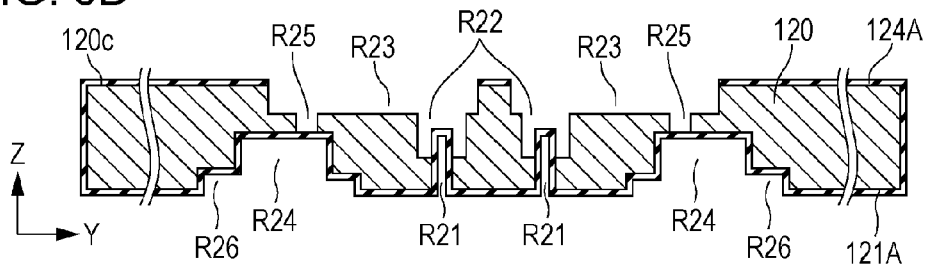

As illustrated in FIG. 6D, for example, the resist pattern 126 is removed by washing with the sulfuric acid hydrogen peroxide, and thereafter, by using the oxide film pattern 124A as a mask, the region R23 which becomes the pressure generating chamber 23 is etched by the anisotropic dry etching, for example, only to the depth of 40 μm. At this time, the region R22 which becomes the nozzle communication hole 22, and the region R25 which becomes the communication hole 25 are etched into the intact shapes, but the oxide film pattern 124A of the nozzle face 120*a* side becomes an etching stop layer, and the regions does not communicate with the opposite side. The depth of the region R22 which becomes the nozzle communication hole 22, is 90 μm.

Figure 7A:
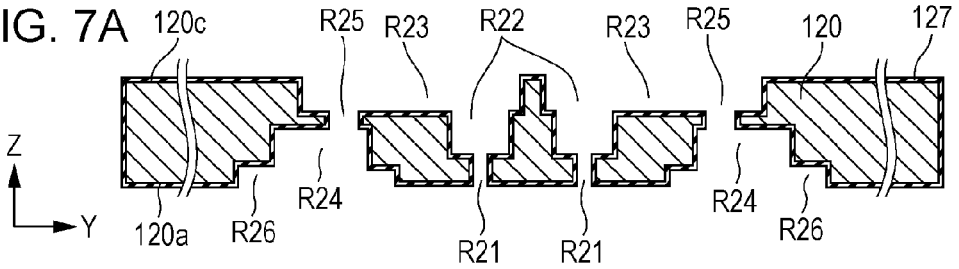
FIGS. 7A to 7E are cross-sectional views illustrating the method for manufacturing a flow path forming substrate according to the first embodiment of the invention.

Next, as illustrated in FIG. 7A, by removing the oxide film pattern 124A with the hydrofluoric acid, the nozzle face 120*a* side and the grinding face 120*c* side communicate therewith, and thereafter, for example, a tantalum oxide film 127 of 0.1 μm is formed on the whole of the wafer for flow path forming substrate 120, by the atomic layer deposition method (ALD) or the thermal CVD.

Figure 7B:
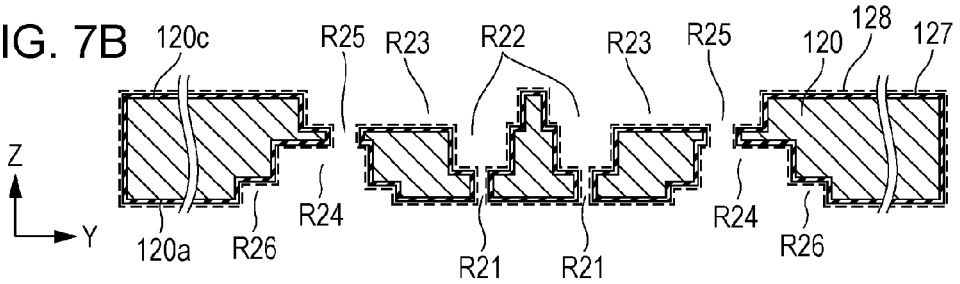

As illustrated in FIG. 7B, by dip coating a silane coupling agent onto the wafer for flow path forming substrate 120, a water repellent film 128 is formed on the whole thereof.

Figure 7C:
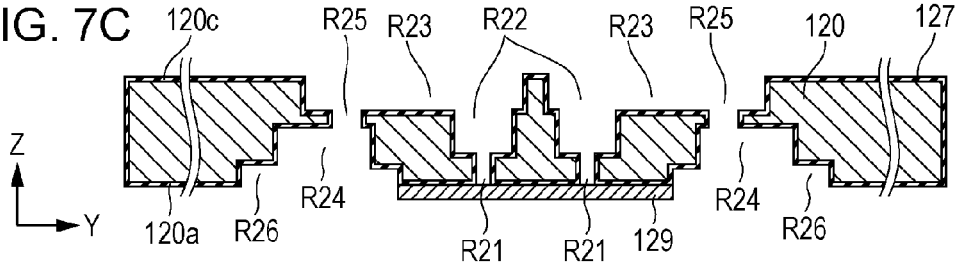

Next, as illustrated in FIG. 7C, a protective tape 129 is selectively bonded into the vicinity of the region R21 which becomes the nozzle opening 21 of the nozzle face 120*a*, and the whole of the wafer for flow path forming substrate 120 is irradiated with oxygen plasma, and the region other than the region which is protected by the protective tape 129, is hydrophilized.

Figure 7D:
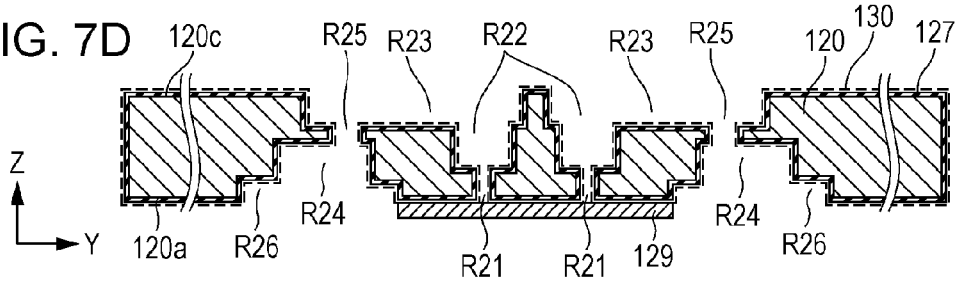

As illustrated in FIG. 7D, by dip coating a primer solution onto the whole of the wafer for flow path forming substrate 120, a hydrophilic primer layer 130 is formed in the region other than the region which is protected by the protective tape 129.

Figure 7E:
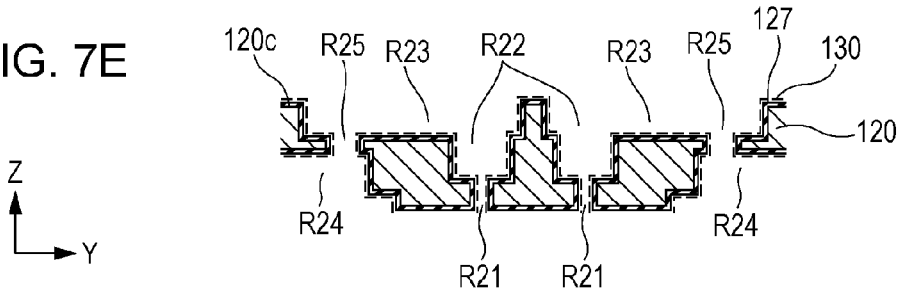

Next, as illustrated in FIG. 7E, the protective tape 129 is peeled off, and thereafter, by stealth dicing using infrared laser, the wafer for flow path forming substrate 120 is diced per flow path forming substrate 20.

In the method for manufacturing a flow path forming substrate described above, it is possible to form the flow path forming substrate 20 which is present from the nozzle opening 21 to the pressure generating chamber 23, by one sheet of the wafer for flow path forming substrate 120. At this time, as described above, since the second manifold portion 42 is formed by the outside of the flow path forming substrate 20 and the case member 40, the area of the flow path forming substrate 20 becomes very small, and thus, the number of products which are obtained from one sheet of the wafer for flow path forming substrate 120, becomes greatly large, and it is possible to further achieve the cost reduction. Additionally, since the nozzle plate is not processed alone, there is the advantage that the processing accuracy of each hole can be secured while securing the rigidity of the nozzle plate portion.

Moreover, in the method for manufacturing a flow path forming substrate described above, a photolithography process and an etching process become simple process designs of each three times (each four times when the stepped concave portion 26 is formed), and it is possible to suppress a manufacturing cost to the minimum. Furthermore, since all of the nozzle opening 21, the nozzle communication holes 22, the pressure generating chamber 23, the first manifold portion 24 and the communication hole 25 are formed by the anisotropic dry etching, it is possible to enhance the processing accuracy. Still more, since it is possible to manufacture the flow path forming substrate by thinning a commercially available silicon substrate, it is possible to achieve the material cost reduction, and it is possible easily to cope with a design change by making the silicon nozzle substrate have the desired thickness. Furthermore, since the dicing is performed in a final process, it is possible to change by a wafer unit up to the final process, and it is possible to suppress the manufacturing cost.

In the method for manufacturing a flow path forming substrate described above, stacking the oxide film pattern and the resist pattern, and using the resist pattern as a mask and etching the resist pattern, and using the oxide film pattern as a mask and etching the oxide film pattern, are performed in succession, and thus, it is possible to provide a liquid discharge head in which alignment accuracy is very high, and the great high accuracy can be secured in comparison with a stacked structure by bonding, and the nozzle density is high, and the landing position accuracy is favorable, at the low cost.

Furthermore, by a process of forming the protective film, it is possible to form the protective film which is excellent in coatability, on the whole of the substrate surface which is included within the flow path. Moreover, since hundred or more sheets of the substrates are formed and cut at the same time, it is possible to reduce a film formation cost per one sheet.

Additionally, since the dicing is performed by dry cutting without using the cutting water at all, it is possible to perform the dicing without contaminating the flow path and the surface of the flow path forming substrate 20.

For example, the method for arranging the piezoelectric actuator 300 corresponding to the pressure generating chamber 23, may be exemplified as a method of stacking the vibration plate 50 and the piezoelectric actuator 300 which are manufactured by a separate thin-film process, at a stage of FIG. 7D or the stage of FIG. 7E.

Alternatively, as described hereinafter, after FIG. 7A, it is possible to make the ink jet type recording head by a successive process.

FIG. 8A to FIG. 10 are cross-sectional views illustrating a method for manufacturing an ink jet type recording head according to the first embodiment of the invention.

Figure 8A:
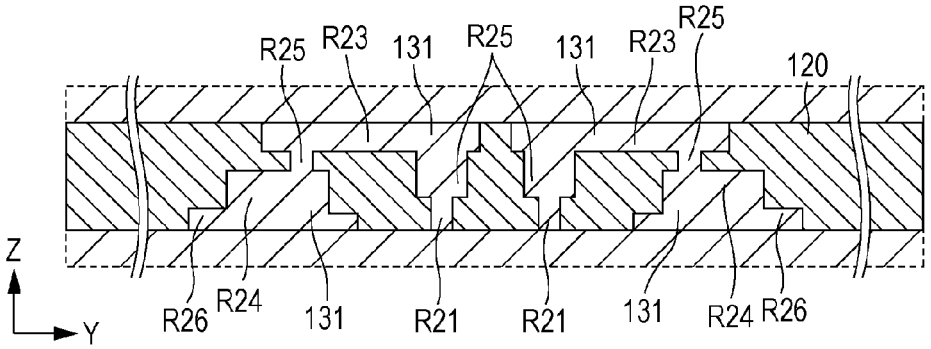
FIGS. 8A to 8C are cross-sectional views illustrating a method for manufacturing a recording head according to the first embodiment of the invention.

As illustrated in FIG. 8A, the concave portion that is formed in the region R23 which becomes the pressure generating chamber 23 of the wafer for flow path forming substrate 120 where the process of FIG. 6D is finished, the region R22 which becomes the nozzle communication hole 22, the region R25 which becomes the communication hole 25, the region R24 which becomes the first manifold portion 24, the region R21 which becomes the nozzle opening 21, and the region R26 which becomes the stepped concave portion 26, is filled with a sacrificial layer 131. Specifically, in the first embodiment, the sacrificial layer 131 is formed over the whole face of the flow path forming substrate, and thereafter, the sacrificial layer 131 other than the concave portion, is removed by chemical mechanical polishing (CMP), and is flattened.

The material of the sacrificial layer 131 is not particularly limited. For example, polysilicon, phosphorus doped silicon oxide (PSG), or the like may be used. In the first embodiment, the PSG of which an etching rate is relatively fast, is used.

The method for forming the sacrificial layer 131 is not particularly limited. For example, the method such as a so-called gas deposition method or a so-called jet molding method which forms the film by colliding ultrafine particles of 1 μm or less to the substrate at high speed due to the pressure of the gas such as helium (He), may be used. In the method, it is possible to partially form the sacrificial layer 131 only in the region corresponding to the concave portion.

Figure 8B:
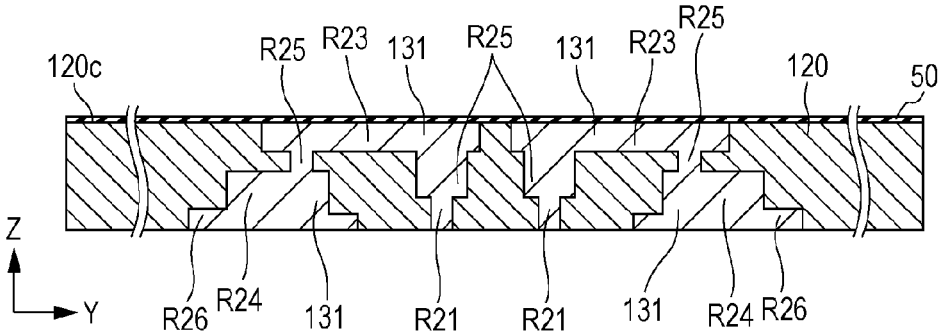

Next, as illustrated in FIG. 8B, the vibration plate 50 is formed on the grinding face 120*c* side.

Here, for example, the vibration plate 50 is made up of the zirconium oxide ($ZrO_2$). In the first embodiment, a zirconium layer is formed, and thereafter, the vibration plate 50 is made up of the zirconium oxide, for example, by the thermal oxidation in a diffusion furnace at 500° C. to 1200° C.

The material of the vibration plate 50 is not particularly limited as long as the material is not etched, at the time of removing the sacrificial layer 131. For example, the material thereof may be a silicon nitride (SiN) or the like.

Figure 8C:
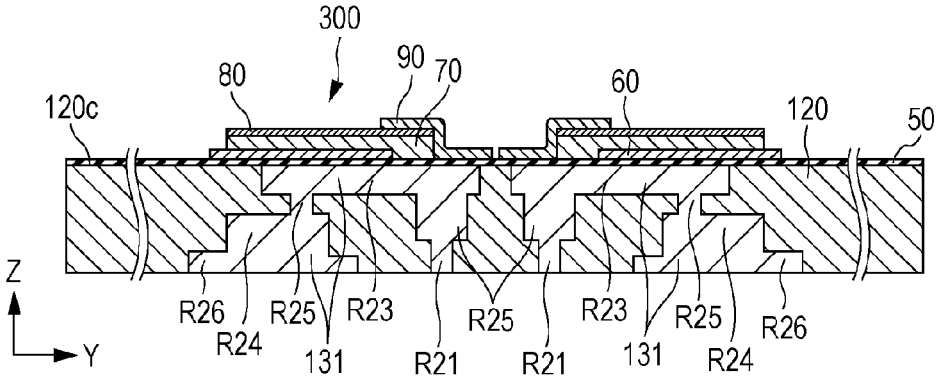

Next, as illustrate in FIG. 8C, on the vibration plate 50, the lower electrode film 60, the piezoelectric layer 70 and the upper electrode film 80 configuring a piezoelectric element, are sequentially stacked, and the piezoelectric actuator 300 is formed by patterning the lower electrode film 60, the piezoelectric layer 70 and the upper electrode film 80. Moreover, the lead electrode 90 is connected to the upper electrode film 80.

Here, as a material of the lower electrode film 60, iridium or platinum is suitable. The piezoelectric layer 70 described later which is formed by the sputtering method or a sol-gel method, is necessary to be crystallized by firing at the temperature of approximately 600° C. to 1000° C. under the atmosphere or oxygen atmosphere after the film formation, and thus, the iridium or the platinum is suitable. That is, the material of the lower electrode film 60, can necessarily retain the conductivity under the oxidizing atmosphere, at the high temperature, and in particular, in the case of using the lead zirconate titanate (PZT) as a piezoelectric layer 70 it is preferable that a conductivity change due to the diffusion of the lead oxide is small, and the iridium or the platinum is suitable from the reasons.

Moreover, it is preferable that the crystals of the piezoelectric layer 70 are oriented, and as a material thereof, the crystals [(Ba, Sr) $TiO_3$ (BST)] of the lead zirconate titanate (PZT)-based material, the barium titanate (BTO), the barium titanate and strontium titanate, and the like are preferable. In the first embodiment, the PZT-based material is used, and the gelation is performed by coating and drying the so-called sol where the metal organic material is dissolved and dispersed in the solvent, and the piezoelectric layer 70 which is made up of the metal oxide, is obtained by further firing at the high temperature, and is formed using the so-called sol-gel method. The method for forming the piezoelectric layer 70 is not particularly limited, and for example, may be formed by the spin coating method such as the sputtering method or an MOD method (organic metal thermal coating decomposition method).

Furthermore, a precursor film of lead zirconate titanate is formed by the sol-gel method, the sputtering method or the MOD method, and thereafter, a method for growing the crystals at a low temperature by a high-pressure processing method in the alkaline aqueous solution, may be used.

As a material of the upper electrode film 80, the material in which the conductivity is high, and the electromigration is not almost generated, for example, the metal such as iridium or platinum, or the oxide thereof is preferable. In the first embodiment, the upper electrode film 80 is formed by performing the sputtering method to the iridium.

Figure 9A:
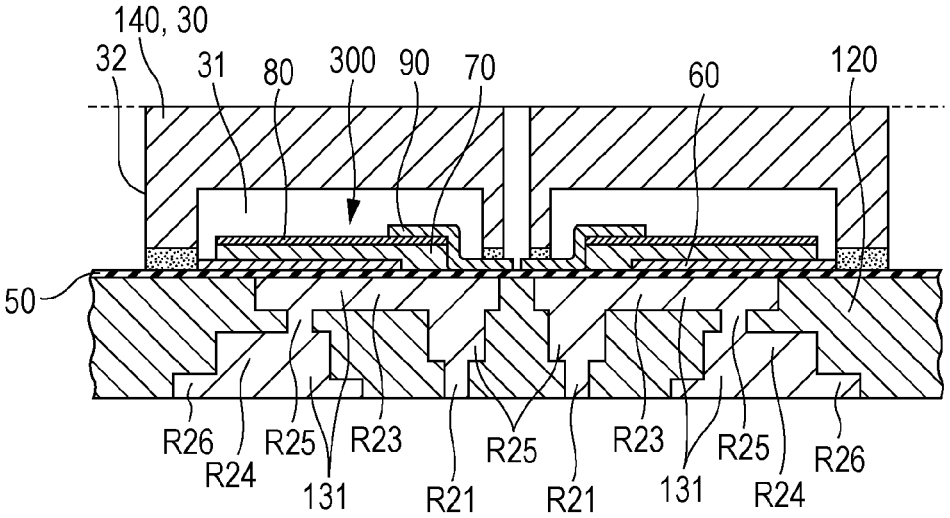
FIGS. 9A and 9B are cross-sectional views illustrating the method for manufacturing a recording head according to the first embodiment of the invention.

Next, as illustrated in FIG. 9A, a wafer for protective substrate 140 which is the silicon wafer and becomes the plurality of the protective substrates 30, is joined to the piezoelectric actuator 300 side of the wafer for flow path forming substrate 120, through the adhesive agent 210. The retaining portion 31 and the through hole 32 are formed in advance on the wafer for protective substrate 140 which is joined to the wafer for flow path forming substrate 120, and the wafer for protective substrate 140 and the wafer for flow path forming substrate 120 are bonded, through the adhesive agent 210. The method for forming the retaining portion 31 and the through hole 32 on the wafer for protective substrate 140, is not particularly limited, and it can be formed at high accuracy, for example, by the anisotropic etching using the alkaline solution such as KOH.

Figure 9B:
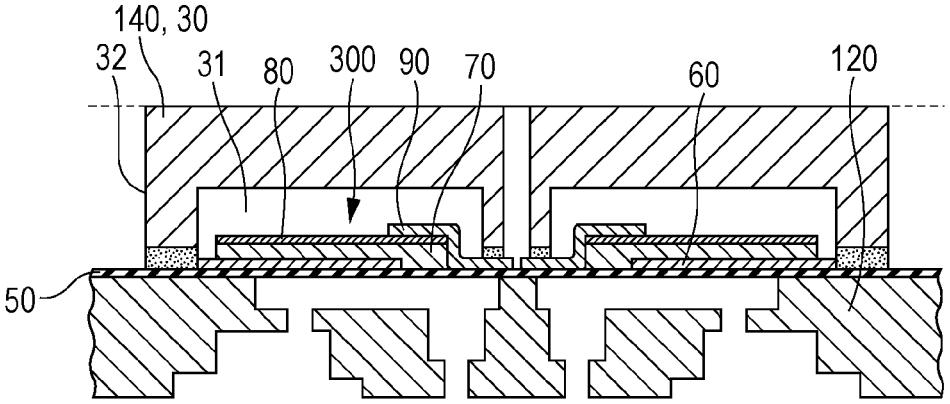

As illustrated in FIG. 9B, the oxide film on the nozzle face 120*a* side of the wafer for flow path forming substrate 120, is removed, and the sacrificial layer 131 is removed by the wet etching. In the first embodiment, since the PSG is used as a material of the sacrificial layer 131, the etching by hydrofluoric acid aqueous solution, is performed. Moreover, when the polysilicon is used, it is possible to perform the etching by the mixed aqueous solution of hydrofluoric acid and nitric acid, or potassium hydroxide aqueous solution. The method for removing the sacrificial layer 131, is not limited to the wet etching, and for example, it is also possible to perform the etching by hydrofluoric acid vapor.

Although the description there will be omitted in the following drawings, the non-main portions of the wafer for flow path forming substrate 120 and the wafer for protective substrate 140, are removed, and the wafer for flow path forming substrate 120 and the wafer for protective substrate 140 are divided into the flow path forming substrate 20 and the protective substrate 30 of one chip size, as illustrated in FIG. 1.

Thereafter, by joining the case member 40 and the fixing plate 45, it is possible to make the ink jet type recording head I of the first embodiment illustrated in FIG. 2.

Other Embodiments

Hitherto, the basic configuration of the invention is described, but the basic configuration of the invention is not limited to the above description.

In the embodiment described above, the case of using the thin-film type piezoelectric actuator 300 as a pressure generating unit that discharges the ink droplet from the nozzle openings 21, is described, but it is not particularly limited thereto. For example, it is possible to use the thick-film type piezoelectric actuator which is formed by the method such as bonding a green sheet, or a vertical vibration type piezoelectric actuator which is expanded and contracted in an axis direction by alternately stacking a piezoelectric material and an electrode forming material. Moreover, it is possible to use the actuator where a heating element is placed as a pressure generating unit within the pressure generating chamber, and the liquid droplet is discharged from the nozzle opening due to bubbles which are generated by the heating of the heating element, or a so-called electrostatic type actuator where static electricity is generated between the vibration plate and the electrode, and the liquid droplet is discharged from the nozzle opening by deforming the vibration plate due to the electrostatic force.

The second manifold portion which becomes the reservoir, is placed on the outside of the end face of the flow path forming substrate, but on the opposite side to the liquid ejecting side, for example, the protective substrate, the separate member which is different from the protective substrate, may be formed.

Figure 10:
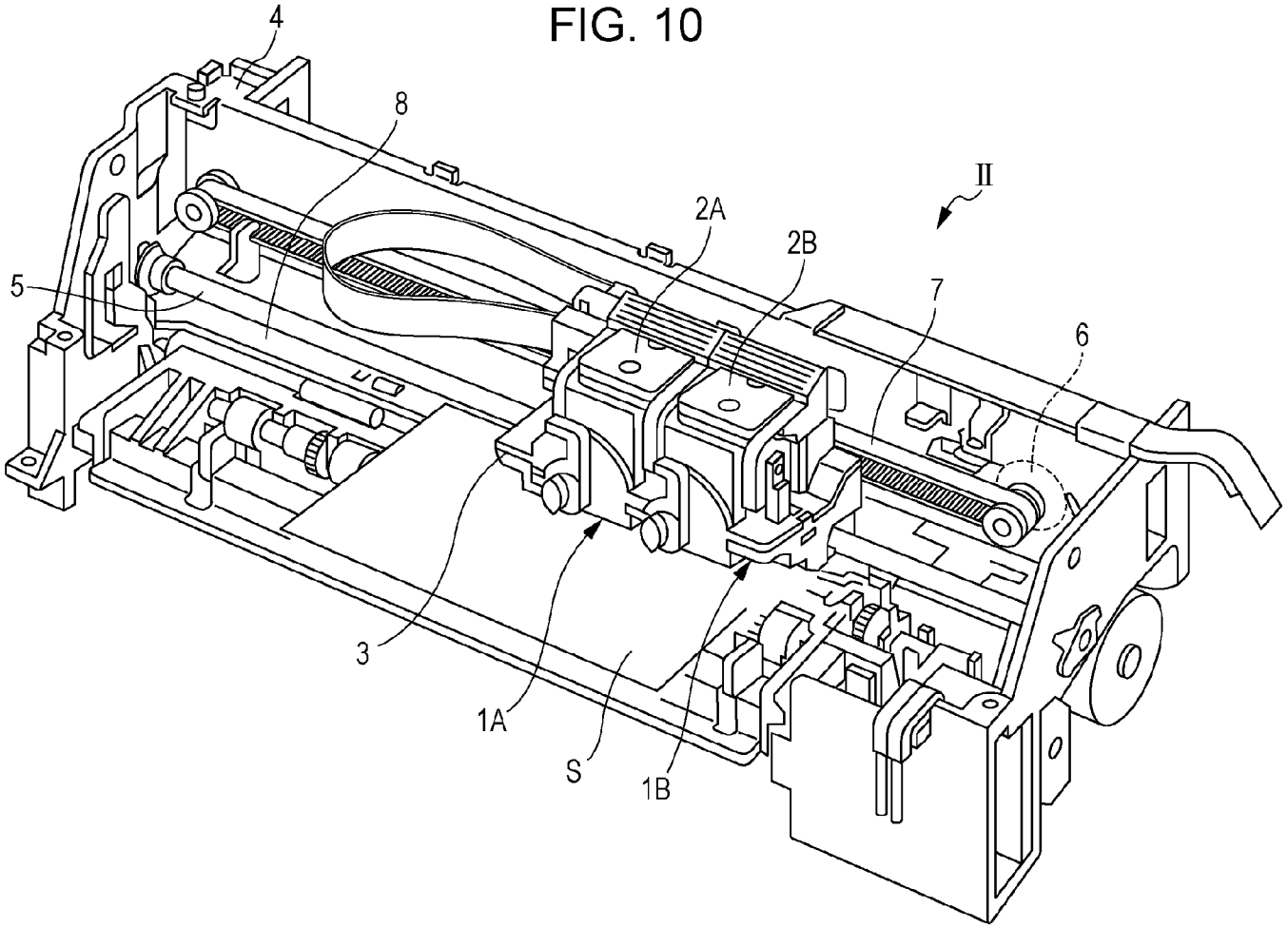
FIG. 10 is a schematic perspective view of a recording apparatus according to an embodiment of the invention.

Furthermore, the ink jet type recording head of each embodiment configures a portion of an ink jet type recording head unit including the ink flow path which communicates with the cartridge or the like, and is mounted on an ink jet type recording apparatus. FIG. 10 is a schematic view illustrating an example of the ink jet type recording apparatus.

In an ink jet type recording apparatus II illustrated in FIG. 10, ink jet type recording head units 1A and 1B (referred to as the head units 1A and 1B, hereinafter) having the plurality of the ink jet type recording heads I, are arranged. Cartridges 2A and 2B configuring the ink supply units, are arranged to be detachable, and a carriage 3 on which the head units 1A and 1B are mounted, is arranged to be movable in the axis direction onto a carriage shaft 5 which is bonded to an apparatus main body 4. For example, the head units 1A and 1B are the head unit which discharge black ink composition and color ink composition, respectively.

Therefore, by transmitting the drive force of a drive motor 6 to the carriage 3, through a plurality of gears not illustrated in the drawing and a timing belt 7, the carriage 3 on which the head units 1A and 1B are mounted, is moved along the carriage shaft 5. On the other hand, a transport roller 8 is arranged along the carriage shaft 5 in the apparatus main body 4, and a recording sheet S that is a recording medium such as paper which is fed by a paper feeding roller not illustrated in the drawing, is wound around the transport roller 8, and is transported.

In the ink jet type recording apparatus II described above, the case that the ink jet type recording head I (recording head unit 1) is mounted on the carriage 3, and is moved in a main scan direction, is exemplified, but it is not particularly limited thereto. For example, the ink jet type recording head I is fixed, and the printing is performed only by moving the recording sheet S such as the paper in a sub-scan direction, and the invention can be also applied to a so-called line type recording apparatus.

In the examples described above, the ink jet type recording apparatus II has the configuration where the cartridge 2A and 2B which are liquid reserving units, are mounted on the carriage 3, but it is not particularly limited thereto. For example, the liquid reserving unit such as an ink tank, is fixed to the apparatus main body 4, and the reserving unit and the ink jet type recording head I, may be connected through a supply pipe such as a tube. Moreover, the liquid reserving unit may not be mounted on the ink jet type recording apparatus II.

In the above embodiments, the ink jet type recording head is used and described as an example of the liquid ejecting head, and the ink jet type recording apparatus is used and described as an example of the liquid ejecting apparatus, but the invention widely makes the liquid ejecting head and the liquid ejecting apparatus in general, as a target, and needless to say, it can be applied to the liquid ejecting head and the liquid ejecting apparatus which eject the liquid other than the ink. As other liquid ejecting heads, for example, various types of recording heads which are used in an image recording apparatus such as a printer, a color material ejecting head which is used for manufacturing a color filter such as a liquid crystal display, an organic EL display, an electrode material ejecting head which is used for forming the electrode such as a FED (field emission display), and a bio-organic material ejecting head which is used for manufacturing a bio-chip, are exemplified, and the invention can also be applied to the liquid ejecting apparatus including such the liquid ejecting head.

The entire disclosure of Japanese Patent Application No. 2014-077581, filed Apr. 4, 2014 is expressly incorporated by reference herein.

What is claimed is:

1. A liquid ejecting head comprising:

a nozzle opening that is formed on one face of a silicon substrate, and ejects liquid;

a first concave portion that is provided on the other face of the silicon substrate, and configures a pressure generating chamber which communicates with the nozzle opening;

a second concave portion that is provided on one face of the silicon substrate, and configures a flow path which communicates with the first concave portion and supplies the liquid;

a vibration plate that seals the first concave portion, and generates pressure within the pressure generating chamber, on the other face of the silicon substrate; and a sealing plate that seals the second concave portion, and configures a portion of a wall face of the flow path, on one face of the silicon substrate, wherein the first concave portion and the second concave portion overlap each other in an in-plane direction when seen in a direction which is orthogonal to the face of the silicon substrate, a stepped concave portion which accommodates the sealing plate, and of which a depth is larger than a thickness of the sealing plate, is provided on one face of the silicon substrate, and the second concave portion is placed on an inside of the stepped concave portion.

2. The liquid ejecting head according to claim 1, wherein a reservoir which reserves the liquid, is placed on an outside of the silicon substrate on a side of an end face connecting one face and the other face of the silicon substrate, or is placed on the outside of the silicon substrate on the other face side.

3. The liquid ejecting head according to claim 2, wherein the reservoir is placed on the outside of the silicon substrate on the end face side, and a flexible film which is placed to face the reservoir, is included in at least a portion of the sealing plate.

4. A liquid ejecting apparatus on which the liquid ejecting head according to claim 3 is mounted.

5. A liquid ejecting apparatus on which the liquid ejecting head according to claim 2 is mounted.

6. The liquid ejecting head according to claim 1, wherein the sealing plate configures a fixing plate that is placed on an outermost side of the silicon substrate on the other face side where the nozzle opening is formed.

7. A liquid ejecting apparatus on which the liquid ejecting head according to claim 6 is mounted.

8. A liquid ejecting apparatus on which the liquid ejecting head according to claim 1 is mounted.

* * * * *